United States Patent [19]

Toda et al.

[11] Patent Number: 4,745,384

[45] Date of Patent: May 17, 1988

[54] CIRCUIT INTERRUPTER

[75] Inventors: Haruhisa Toda; Toshiyuki Tanibe, both of Fukuyama, Japan

[73] Assignee: Mitsubishi Denki Kabushiki Kaisha, Japan

[21] Appl. No.: 75,685

[22] Filed: Jul. 20, 1987

[30] Foreign Application Priority Data

Jul. 24, 1986 [JP] Japan ..... 61-114681[U]

[51] Int. Cl.[4] ..... H01H 3/00

[52] U.S. Cl. ..... 335/195; 335/190; 200/147 R

[58] Field of Search ..... 335/16, 147, 195, 190; 200/147 R, 153 G, 153 H

[56] References Cited

U.S. PATENT DOCUMENTS 3,492,609 1/1970 Murai et al. ..... 335/16

4,227,161 10/1980 Yamat et al. ..... 335/16

*Primary Examiner*—E. A. Goldberg

*Assistant Examiner*—Lincoln Donovan

*Attorney, Agent, or Firm*—Leydig, Voit & Mayer

[57] ABSTRACT

A circuit interrupter comprises a contact arm assembly for supporting the movable contact composed of a first contact arm and a second contact arm pivotally supported by a common pin, the first contact arm having an elongated guide hole extending in the direction of movement of the movable contact, the second contact arm having an elongated hole extending substantially in the direction of extension of the second contact arm. A second pin extends through the elongated hole and the guide hole, and a spring is provided for biasing the second pin. The elongated hole has a pin sliding surface on which the second pin slides and which forms an angle of 90° or more with respect to a pin sliding surface of the elongated pin guide hole when the first contact arm is being reset after the second contact arm is separated by an electromagnetic repulsive force.

1 Claim, 7 Drawing Sheets

CIRCUIT INTERRUPTER

BACKGROUND OF THE INVENTION

This invention relates to a circuit interrupter in which a movable contact is moved to open by an electromagnetic repulsive force resulting from a massive current irrespective of the interrupting operation by an automatic trip mechanism.

A conventional circuit interrupter to which the present invention pertains will be described in conjunction with FIGS. 1 to 6. FIG. 1 is a sectional side view of the conventional circuit interrupter, FIG. 2 is a partial enlarged sectional view of FIG. 1 showing the ON position, FIG. 3 is a view similar to FIG. 2, but illustrating the OFF position, FIG. 4 is a view similar to FIG. 2, but illustrating the TRIP position, FIG. 5 is a view similar to FIG. 2, but illustrating the electromagnetically operated position, and FIG. 6 is a view similar to FIG. 2. but illustrating the position at which the first contact arm is being reset.

In these figures, the circuit interrupter comprises an electrically insulating housing 1 composed of a base 1*a* and a cover 1*b*. A stationary source side conductor 2 is mounted on the base 1*a* and has a stationary contact 3 secured thereon. An automatic trip unit 4 is mounted in the housing 1, and a stationary load side conductor 4 is electrically connected to the automatic trip unit 4. A movable contact 6 is secured to a movable member 7 which is electrically connected to the automatic trip unit 4 through a flexible conductor 8 and a connector 9. The movable member 7 is supported by a contact arm assembly 10 comprising a first contact arm 10*a* connected to an operating mechanism 20 which will be described in more detail later, and a second contact arm 10*b* on which the movable member 7 is pivotally supported by a first pin 11. The first contact arm 10*a* of each pole unit is also connected to a cross bar 13 for the simultaneous movement of the pole units. The first contact arm 10*a* and the second contact arm 10*b* are pivotally supported independently within the housing by a pivot pin 12. The first contact arm 10*a* has formed therein a first guide hole 14 extending substantially in the direction of the movement of the contact arm 10*a*. The second contact arm 10*b* has formed therein a second elongated guide hole 15 extending in the direction of extension of the arm 10*b*. A pin 16 extends through the first and the second guide holes 14 and 15 to limit the relative pivotal movement between the first and the second contact arms 10*a* and 10*b*. The pin 16 is biased toward the free end of the contact arm 10*b* by a tension spring mounted between the pin 16 and the pin 11 pivotally connecting the movable member 7 to the second contact arm 10*b*. In order to provide a contact biasing force between the movable and the stationary contacts 6 and 3, a contact pressure spring 18 is disposed between the movable member 7 and the second contact arm 10*b*. An operating handle 19 is connected to an operating mechanism 20 comprising a releasable cradle 20*a* having a stop pin 21 and a pair of toggle links 20*b* and 20*c* connected between the cradle 20*a* and the first contact arm 10*a* by pivot pins 22*a* and 22*b*. As is well known, an arc extinguisher 23 is disposed in order to extinguish the arc generated between the separated contacts when they are separated.

When the circuit interrupter is in the ON position shown in FIGS. 1 and 2, an electric current flows from the source side stationary conductor 2 to the load side stationary conductor 5 through the stationary contact 3, the movable contact 6, the movable member 7, the flexible conductor 8, the connector 9 and the automatic trip unit in the named order. When the operating handle 19 is moved into the OFF position as shown by an arrow 24 of FIG. 2, the contact arm assembly 10 is lifted by the operating mechanism 20 so that the movable contact 6 together with the movable member 7 is moved away from the stationary contact 3 as shown in FIG. 3 to open the contacts 3 and 6. At this time, since the second pin 16 is positioned in the recessed portion 14*a* of the guide hole 14 due to the biasing function of the tension spring 17, the second contact arm 10*b* is rotated about the pivot pin 12 in the opening direction by the operating mechanism 20 together with the first contact arm 10*a* until it abuts against the stopper pin 21.

In the ON position shown in FIGS. 1 and 2, when an overload current flows through the circuit interrupter, the automatic trip unit 4 is actuated to release the cradle 20*a* of the operating mechanism 20 to allow it to rotate in the direction of an arrow 25 of FIG. 2. Then, the toggle links 20*b* and 20*c* of the operating mechanism 20 rotate the contact arm assembly 10 in the clockwise direction in the figure to separate the movable contact 6 from the stationary contact 3, thereby interrupting the overload current. This is the socalled tripped position. During this operation, since the second pin 16 is positioned within the recessed portion 14*a* of the guide hole 14 due to action of the tension spring 17 similarly to the OFF position shown in FIG. 3, the second contact arm 10*b* is rotated clockwise about the pivot shaft 12 by the operating mechanism 20 together with the first contact arm 10*a* until it abuts against the stopper pin 21.

When a large current such as a short-circuit current flows through the circuit interrupter in the ON position shown in FIGS. 1 and 2, an electromagnetic repulsive force generated between the stationary conductor 2 and the movable member 7 causes the movable member 7 to immediately separate from the stationary conductor 2 as shown in FIG. 5. At this time, since the operating mechanism 20 does not allow the first contact arm 10*a* to be actuated because it has not yet been actuated itself, the second contact arm 10*b* rotates clockwise as shown by an arrow 26 about the shaft 12 by moving the second pin 16 against the spring force of the tension spring 17 from the recessed portion 14*a* along the guide hole 14 until it abuts against the end portion 14*b* of the guide hole 14. An electromagnetic repulsive force is generated very quickly upon the occurence of a short-circuit current and therefore the contact separation is achieved before the automatic try unit 4 is actuated, providing a high current limiting capability.

Immediately after the electromagnetic repulsive separation is achieved, the automatic trip unit 4 trips and rotates the first contact arm 10*a* to return the second pin 16 into the recessed portion 14*a* of the guide hole 14 after it has passed the position shown in FIG. 6 to take up the tripped position shown in FIG. 4. This is called the resetting of the contact arm assembly 10. At this time, the second pin 16 is moved along the pin sliding surface 15*a* of the elongated hole 15 while being biased by the tension spring 17 against the pin sliding surface 14*c* of the guide hole 14.

With the conventional circuit interrupter as above described, the angle $\theta_1$ defined between the pin sliding surface 15*a* of the elongated hole 15 along which the second pin 16 slides and the pin sliding surface 14*c* of the guide hole 14 is smaller than 90°, the resetting force (upward) of the first contact arm 10*a* causes a force that presses the second pin 16 downward against the pin sliding surface 15*a* of the elongated hole 15. Then, the second pin 16 is sandwiched between the pin sliding surface 15*a* of the elongated hole 15 and the pin sliding surface 14*c* of the guide hole 14 by the above resetting force, making the movement of the first contact arm 10*a* poor and increasing the resetting load, to require a disadvantageously large mechanical force.

SUMMARY OF THE INVENTION

Accordingly, an object of the present invention is to provide a circuit interrupter in which the resetting of the contact arm assembly can be smoothly made.

Another object of the present invention is to provide a circuit interrupter in which the second pin of the contact arm assembly can be made to move smoothly during the resetting of the first contact arm.

Still another object of the present invention is to provide a circuit interrupter with a simple the structure.

With the above objects in view, a circuit interrupter comprises a contact arm assembly for supporting the movable contact composed of a first contact arm and a second contact arm pivotally supported by a common pin, the first contact arm having an elongated guide hole extending in the direction of movement of the movable contact, the second contact arm having an elongated hole extending substantially in the direction of extension of the second contact arm. A second pin extends through the elongated hole and the guide hole, and a spring is provided for biasing this second pin. The elongated hole has a pin sliding surface on which the second pin slides and which forms an angle of 90° or more with respect to a pin sliding surface of the pin guide hole when the first contact arm is being reset after the second contact arm is separated by an electromagnetic repulsive force.

According to the present invention, the angle defined between the pin sliding surface of the elongated hole and the pin sliding surface of the guide hole is equal to or more than 90°, so that the second pin is not caught between the sliding surfaces during the resetting operation of the first contact arm, ensuring smooth movement.

BRIEF DESCRIPTION OF THE DRAWINGS

The present invention will become more readily apparent from the following detailed description of the preferred embodiment of the present invention taken in conjunction with the accompanying drawings, in which.

PREFERRED EMBODIMENT OF THE INVENTION

Figure 1:
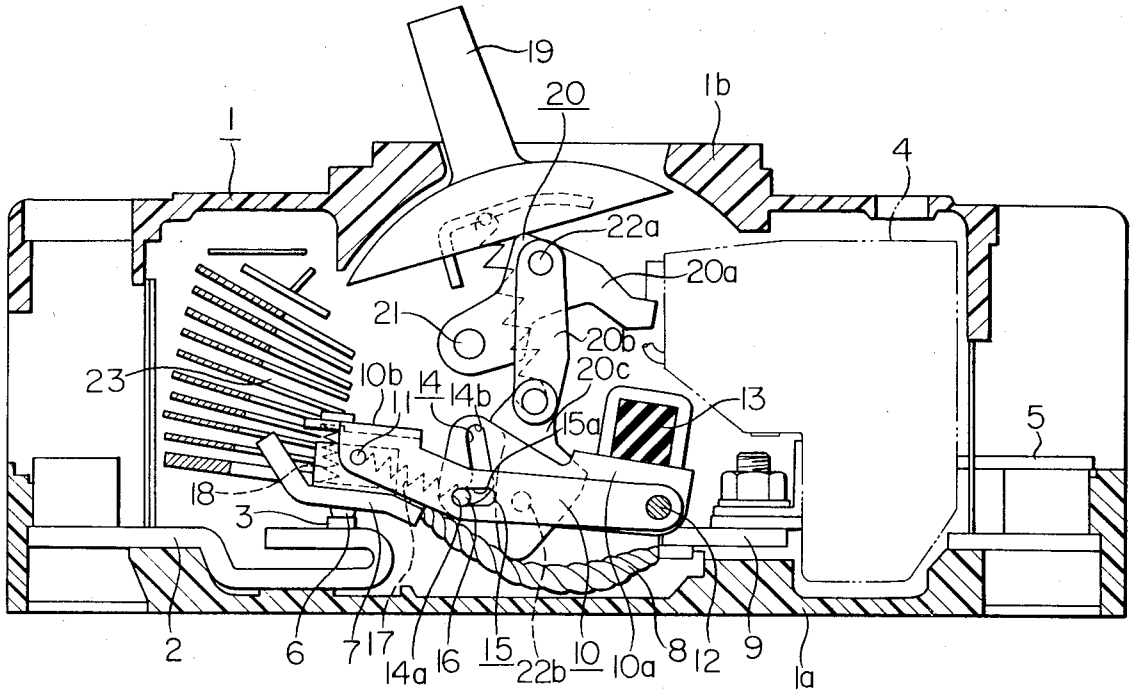
FIG. 1 PRIOR ART
FIG. 1 is a cross sectional side view showing one embodiment of the present invention.
Figure 2:
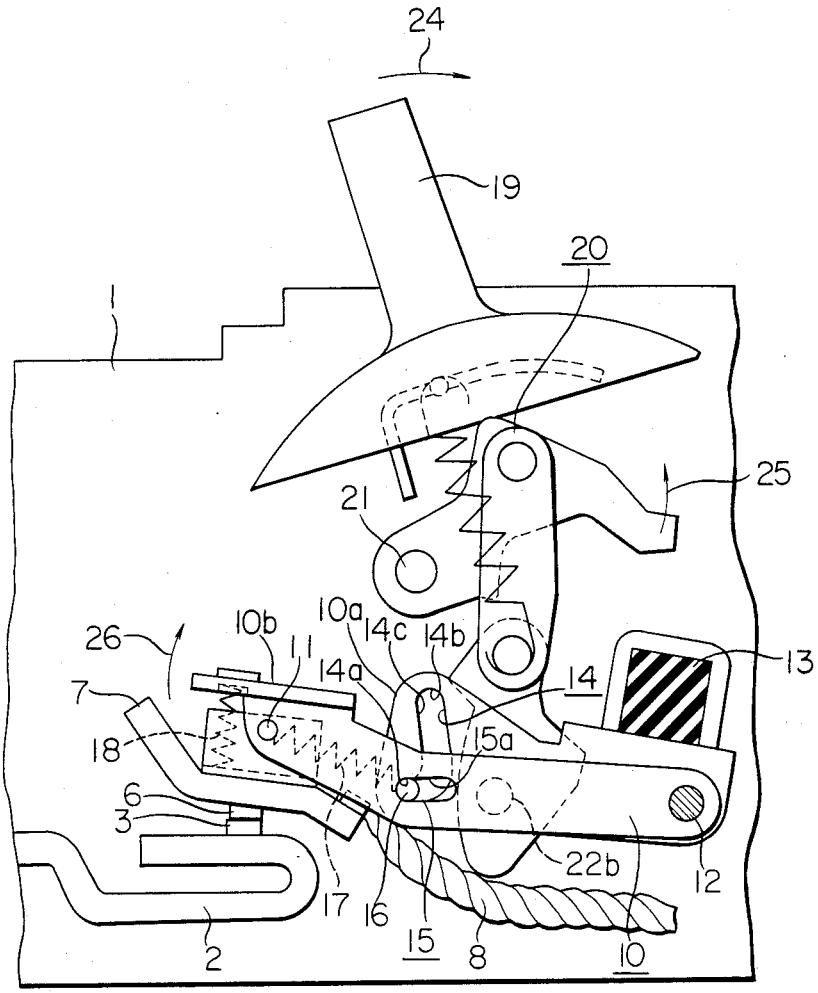
FIG. 2 PRIOR ART
FIG. 2 is a fragmental enlarged view of FIG. 1 showing the ON position.
Figure 3:
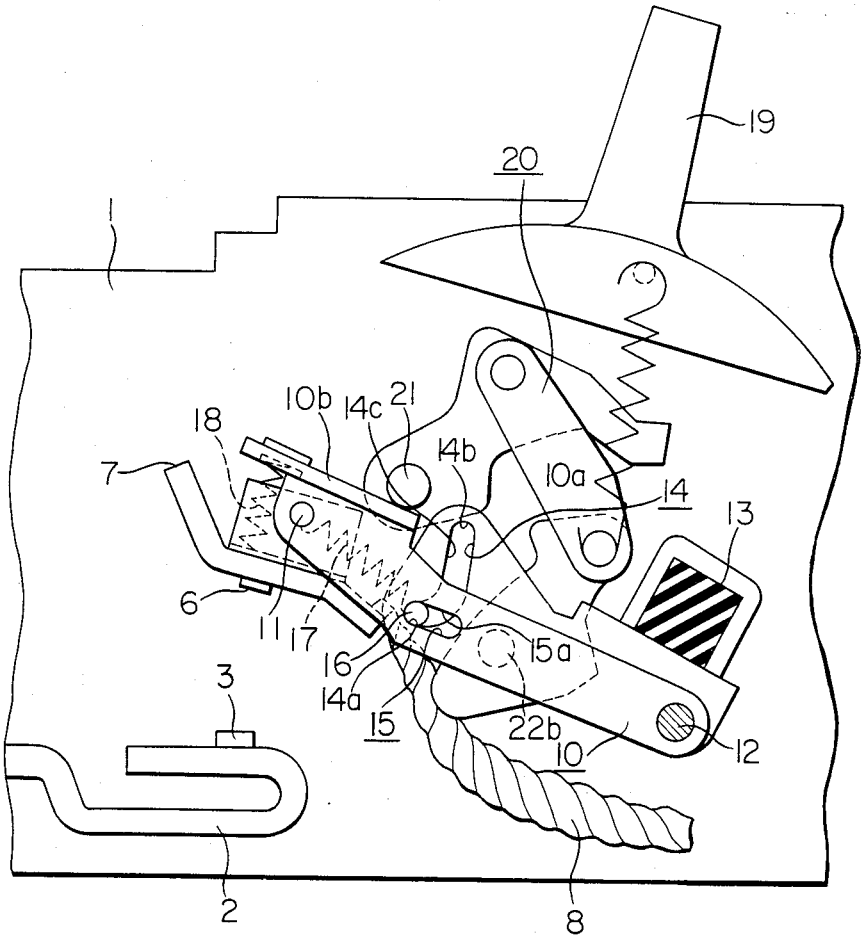
FIG. 3 PRIOR ART
FIG. 3 is a view similar to FIG. 2, but showing the OFF position.
Figure 4:
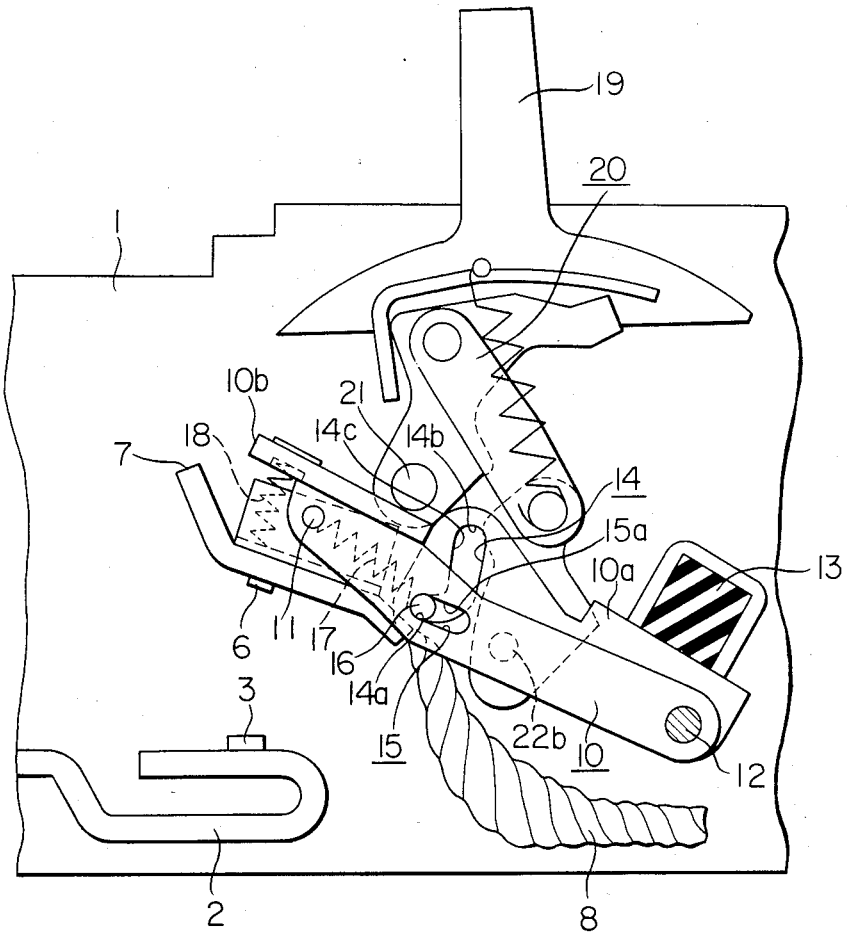
FIG. 4 PRIOR ART
FIG. 4 is a view similar to FIG. 2 , but showing the tripped position.
Figure 5:
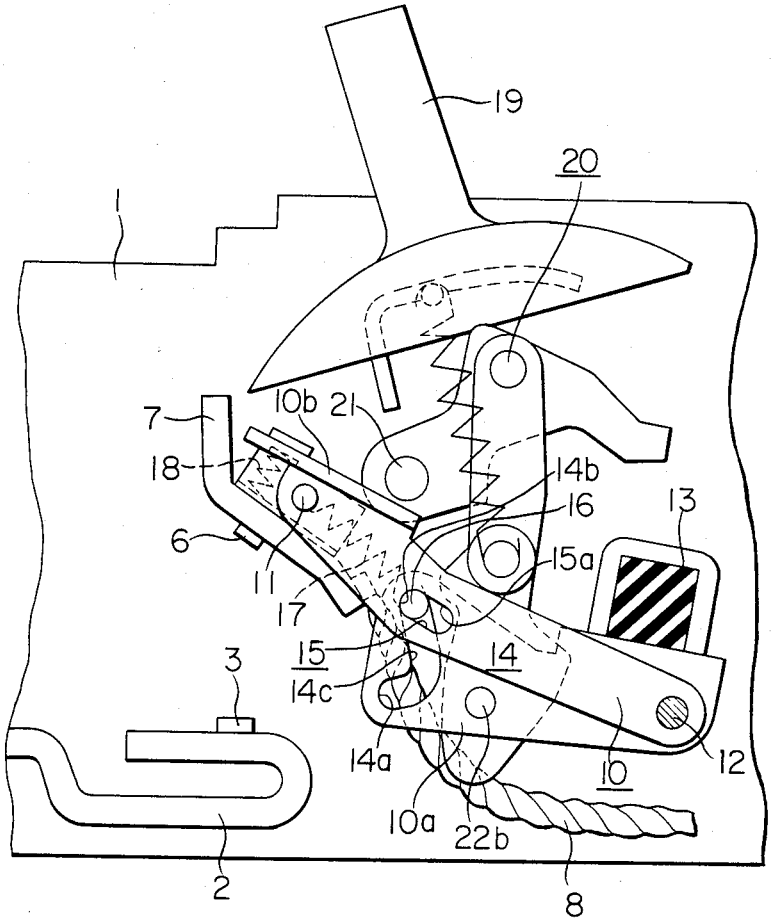
FIG. 5 PRIOR ART
FIG. 5 is a view similar to FIG. 2, but showing the position after being separated by the electromagnetic repulsive force.
Figure 6:
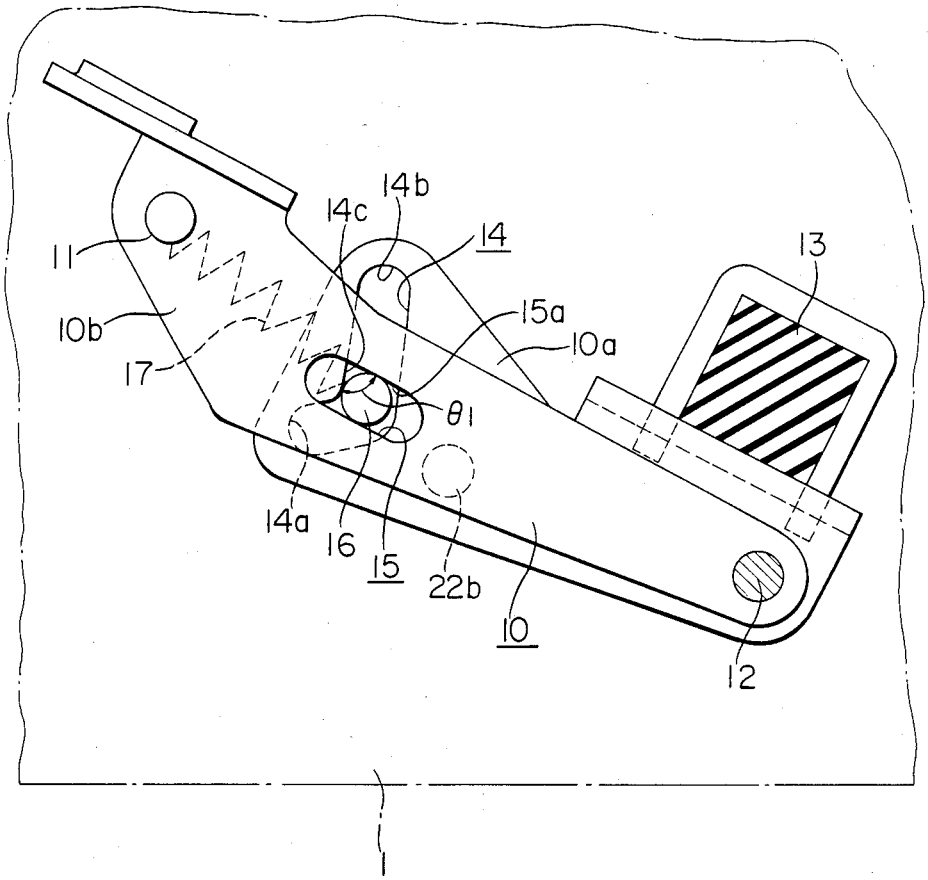
FIG. 6 PRIOR ART
FIG. 6 is a view similar to FIG. 2, but showing the position during resetting.
Figure 7:
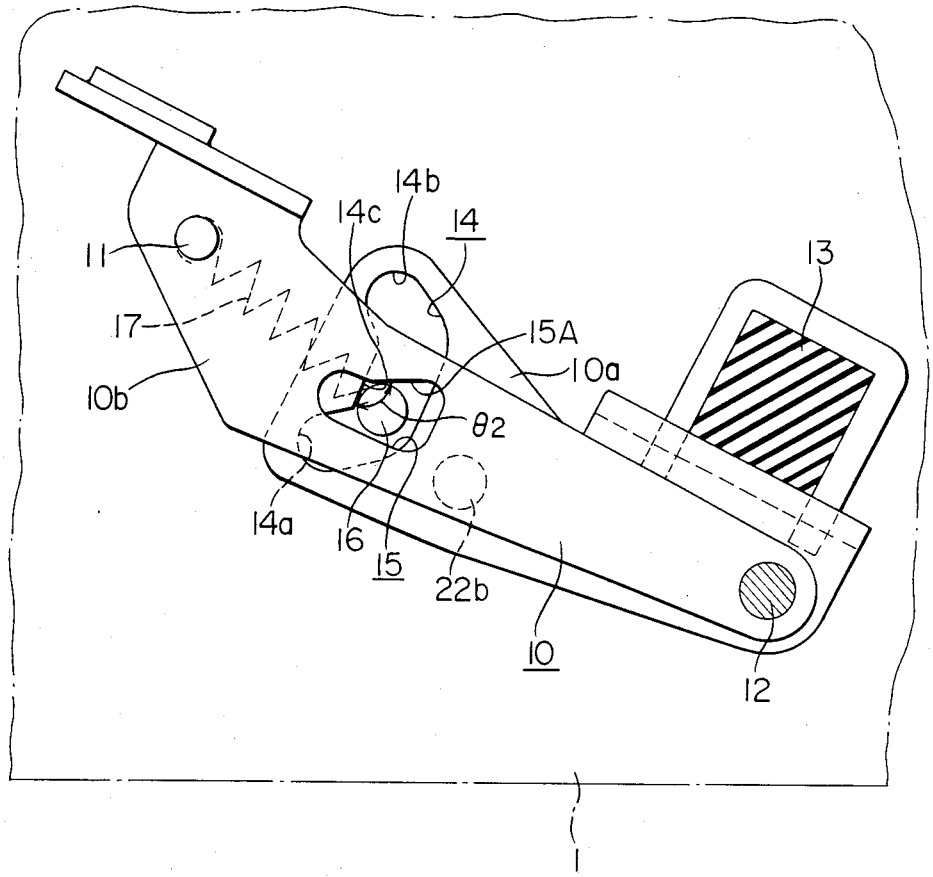
FIG. 7 is a fragmetanl enlarged view showing the main portion of the circuit interrupter of the present invention.

FIG. 7 illustrates one embodiment of the present invention in a fragmental enlarged view similar to FIG. 6. The same reference numerals designate components identical with or corresponding to those used in the previous figures. In FIG. 7, the elongated hole 15 has a pin sliding surface 15A which defines an angle $\theta_2$ equal to or more than 90° with respect to the pin sliding surface 14*c* of the guide hole 14. In other respects, the structure of the circuit interrupter of the present invention is identical to that of the previously described conventional design.

As the pin sliding surface 15A of the elongated hole 15 of the present invention is angled to define the angle $\theta_2$ relative to the pin sliding surface 14*c* of the pin guide hole 14, the second pin 16 is not pressed and caught between the pin sliding surface 15A of the elongated hole 15 and the pin sliding surface 14*c* of the guide hole 14, so that the second pin 16 can move smoothly along the elongated hole 15.

As has been described, since the angle defined between the pin sliding surface of the elongated hole and the pin sliding surface of the guide hole is equal to or more than 90° according to the present invention, the second pin is not caught between the sliding surfaces during the resetting operation of the first contact arm, ensuring a smooth movement and a simpler structure.

What is claimed is:

1. A circuit interrupter arranged to open by an electromagnetic repulsive force upon the ocurrence of a large overcurrent by separating a movable contact from a stationary contact irrespective of an automatic trip operation of an operating mechanism, comprising;

a contact arm assembly for supporting the movable contact composed of a first contact arm and a second contact arm pivotally supported by a common pin, said first contact arm having an elongated guide hole extending in the direction of movement of said movable contact, said second contact arm having an elongated hole extending substantially in the direction of extension of said second contact arm, a spring biased second pin extending through said elongated hole and said guide hole, said elongated hole having a pin sliding surface on which said second pin slides and which forms an angle of 90° or more with respect to a pin sliding surface of said elongated pin guide hole when said first contact arm is being reset after said second contact arm is separated by an electromagnetic repulsive force.

* * * * *